US008708624B1

(12) United States Patent
Marusiak

(10) Patent No.: US 8,708,624 B1
(45) Date of Patent: Apr. 29, 2014

(54) ROUTER CHIP GUARD

(76) Inventor: Frank Marusiak, Annandale, NJ (US)

( * ) Notice: Subject to any disclaimer, the term of this patent is extended or adjusted under 35 U.S.C. 154(b) by 254 days.

(21) Appl. No.: 13/068,139

(22) Filed: May 3, 2011

Related U.S. Application Data

(60) Provisional application No. 61/343,847, filed on May 5, 2010.

(51) Int. Cl.
*B27C 5/10* (2006.01)

(52) U.S. Cl.
USPC ..... 409/182; 144/136.95; 144/154.5

(58) Field of Classification Search
USPC ..... 409/137, 138, 175, 178, 181, 182; 408/67, 110; 144/136.95, 154.5, 251.1, 144/251.2, 251.3, 252.1
IPC ..... B27C 5/10
See application file for complete search history.

(56) References Cited

U.S. PATENT DOCUMENTS

| | | | | |
|---|---|---|---|---|
| 4,484,845 | A | 11/1984 | Pennella, Jr. et al. | |
| 4,515,504 | A * | 5/1985 | Moore, Sr. | 408/67 |
| 4,572,715 | A * | 2/1986 | Wolff | 409/180 |
| 4,613,261 | A * | 9/1986 | Maier et al. | 409/137 |
| 4,742,855 | A * | 5/1988 | Hartley | 144/252.1 |
| 5,381,842 | A * | 1/1995 | Aigner | 144/251.2 |
| 5,419,662 | A * | 5/1995 | Ericksen | 408/42 |
| 5,445,198 | A * | 8/1995 | McCurry | 144/154.5 |
| 5,509,454 | A | 4/1996 | Giacometti | |
| 6,027,289 | A | 2/2000 | Posh | |
| 7,198,442 | B2 | 4/2007 | Waldron | |
| 7,290,967 | B2 * | 11/2007 | Steimel et al. | 409/137 |

FOREIGN PATENT DOCUMENTS

| | | | | |
|---|---|---|---|---|
| DE | 2749582 A * | 5/1979 | | B23B 45/14 |
| DE | 10124011 A1 * | 1/2002 | | B23B 39/16 |
| DE | 20216066 U1 * | 12/2002 | | B23Q 11/00 |
| DE | 10320082 A1 * | 11/2003 | | B27C 5/10 |
| JP | 08001611 A * | 1/1996 | | B27G 3/00 |
| JP | 2008036943 A * | 2/2008 | | B27C 5/10 |
| WO | WO 2007052032 A1 * | 5/2007 | | B27C 5/10 |

OTHER PUBLICATIONS

Woodshop News (magazine) Jul. 2011, photo on p. 30 (copy attached).
Betterley Industries Inc., 2 pages printed from their website address as listed on originally filed IDS Date printed from website Jun. 8, 2013 Blaine MN 55449.
Rockler Woodworking and Hardware, 1 page printed from their website address as listed on originally filed IDS Date printed from website Jun. 8, 2013 Medina MN 55340.

* cited by examiner

*Primary Examiner* — Daniel Howell
*Assistant Examiner* — Michael Vitale

(57) ABSTRACT

A chip deflector repositionable as needed relative to a bottom work contacting surface of a hand-held power router. The chip deflector can be positioned in a shielding location below the bottom work contacting surface of the router. When the chip deflector is in the shielding position and the router is held so that the deflector is between the cutter and the worker it will deflect debris away from the operator. When not useful the chip deflector can instantly be repositioned to a non-shielding location flush with or above the bottom work contacting surface of the router. When in the non-shielding location no portion of the chip deflector protrudes beyond the bottom work contacting surface of the router thereby allowing the router to perform all basic routing without obstruction. Repositioning requires no tools or downtime plus safety and comfort are enhanced. Embodiments may be provided as original equipment or aftermarket retrofits.

5 Claims, 6 Drawing Sheets

ROUTER CHIP GUARD

CROSS-REFERENCE TO RELATED APPLICATIONS

This application claims the benefit of provisional patent application Ser. No. 61/343,847 filed 2010 May 5 by the present inventor.

FEDERALLY SPONSORED RESEARCH

Not Applicable

SEQUENCE LISTING OR PROGRAM

Not Applicable

BACKGROUND

1. Field

This application relates to the technical field of portable power tool guards, specifically guards for hand held portable routers.

2. Prior Art

Typically basic original equipment router bases and sub bases are provided attached to the router motor. The router base supports the motor and the sub-base is attached to the bottom of the router base. The sub-base provides a smooth, flat work contacting surface which permits the router to slide easily upon the work as the operator advances a rotating router bit along a workpiece. The sub-base also provides a smooth side edge surface which can be slid against a straight edge or template edge to encourage the machine to accurately follow a predetermined cutting path. Some routers do not have a sub-base, instead some manufacturers for example RYOBI use the bottom surface of the base itself as the surface which contacts the workpiece. Optional bases, sub-bases or base attachments also exist which allow the router to perform various dedicated operations for example adjustable circle cutting, adjustable dado cutting, under-scribing and seaming, and more relevant to the present invention chip deflection and dust extraction. One such prior art base option is disclosed in U.S. Pat. No. 7,290,967; issued on Nov. 6, 2007; Inventor, Steimel; Johannes (Neidlingen, Del.). While presumably effective in its general dust extraction purpose this device is an accessory which must be connected to the base of the router and removed as needed. It is designed to be hooked up to a vacuum making it a rather cumbersome attachment. Another prior art example U.S. Pat. No. 7,198,442 B2; issued on Apr. 3, 2007; Inventor, Mike Waldron (Pocklington, GB) similarly focuses on dust extraction via vacuum. To encourage dust extraction Waldron and Steimel both disclose a removable guard portion positioned partially around the router bit and below the bottom work contacting surface of the router. As such during many routing operations this lower guard portion becomes an obstruction which must be removed from the router creating non-productive downtime. When removed the guard portion may become misplaced, lost or forgotten when the router is taken from one job site to another. Reattachment creates additional downtime which at times results in the device not being replaced and therefore not being used at all. Both dust extraction devices are relatively complex and expensive to manufacture and purchase and both create additional weight related operator fatigue. While both Steimel and Waldron both present useful devices which naturally provide some guarding and chip deflection as a by-product of their design, they do not provide a simple or practical always on-board solution for chip deflection, they are designed for dust extraction via vacuum.

Another prior art example U.S. Pat. No. 6,027,289; issued on Feb. 22, 2000; Inventor, Posh; Ransom (Livonia, Mich.) shows an optional chip deflector(s) arrangement which is designed to deflect debris as it exits the openings in the router base. The hinged deflector(s) are located above the work contacting surface of the router therefore they do not provide protection from debris exiting from below the work contacting surface of the router. Other clear plastic devices which cover the openings in the router base and deflect some exiting debris are well known, such devices are also located above the work contacting surface and do not provide protection from debris exiting from below the bottom work contacting surface of the router. Because that is where all the actual cutting occurs most of the debris is expelled from this area.

In another prior art example U.S. Pat. No. 4,484,845; issued on Nov. 27, 1984; Inventor, Pennella, Jr. et. al. shows a "Machine Tool Safety Shield" with removable and repositionable guard members attached to an anchor panel which is universally mountable to machine tools. Machine tools are equipment that cut, shear, punch, press, drill, roll, grind, sand, or form metal, plastic, or wood stock. Not included in this definition are hand-held, portable power, or manual tools.

The objective of the multiple guards is to permit the device to essentially surround the tooling and present a barrier between the cutting tool and the operator. While practical for machine tool applications the Pennella device as well as similar prior art machine tool guards would be impractical, obstructive and counterproductive for use with routers, adding needless cost, weight, and bulk to a hand held power tool.

SUMMARY

Accordingly one object of the present embodiments is to provide a simple, inexpensive chip deflecting guard movably repositionable to and from a shielding and non-shielding location. When in a non-shielding location the guard is positioned flush with or above the bottom work contacting surface of the router and when in the shielding location the guard is positioned below the work contacting surface of the router. When a router is held such that the chip deflecting guard is oriented between the router bit and the operator the guard will deflect cutting debris away from the operator. When not useful the chip deflecting guard need not be removed but rather can be instantly repositioned out of the way thereby allowing the router to perform other basic operations without obstruction.

DRAWINGS

Figures

DRAWINGS

Reference Numerals

Figure 1:
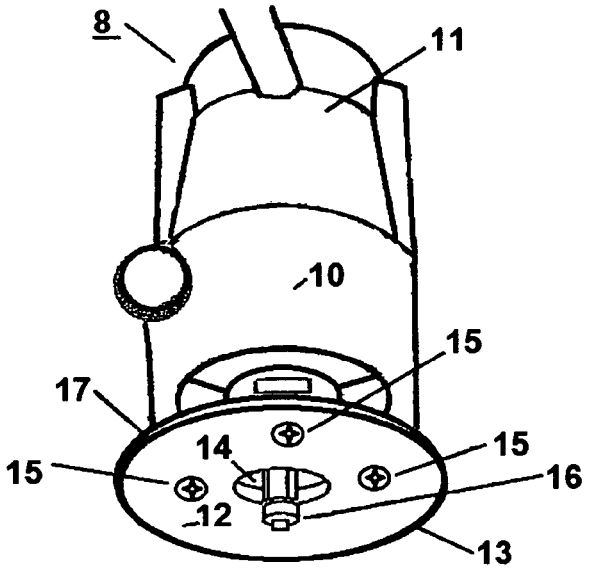
PRIOR ART FIG. 1
FIG. 1 is a perspective view of a router with a basic prior art sub-base.
Figure 2:
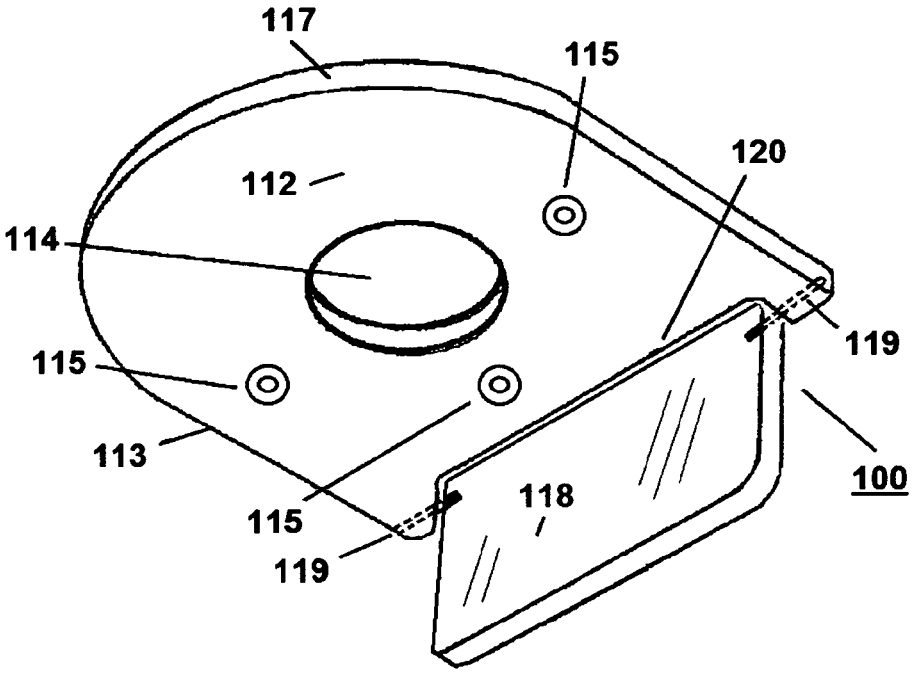
FIG. 2 is a perspective view of a router chip guard sub-base in accordance with a preferred embodiment.
Figure 3:
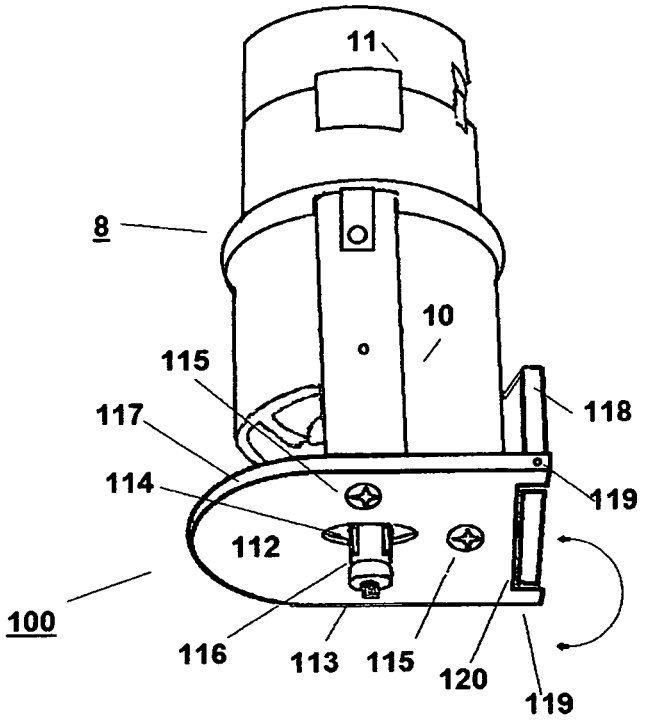
FIG. 3 is a perspective view of a router equipped with a router chip guard sub-base in accordance with the FIG. 2 embodiment shown with a hinged chip deflector in a non-shielding position.
Figure 4:
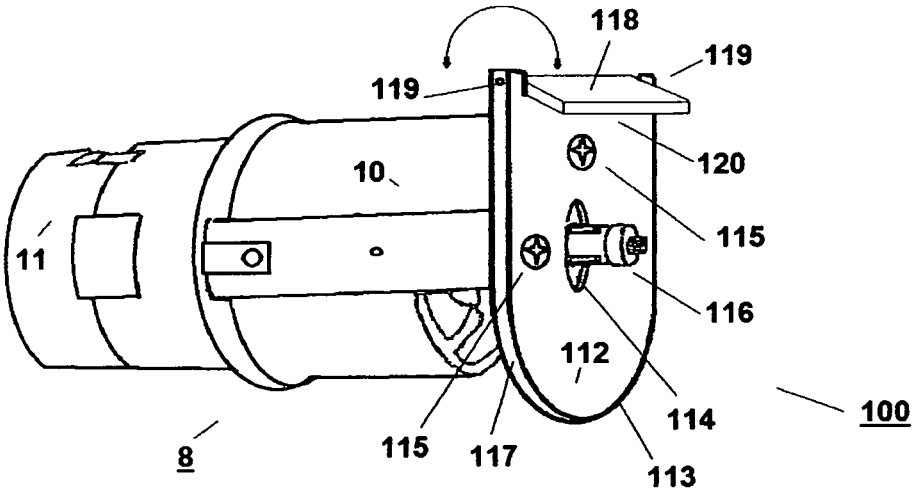
FIG. 4 is a perspective view of a router with a router chip guard sub-base in accordance with the FIG. 2 embodiment showing the hinged chip deflector in a shielding position.

8 router
10 router base
11 motor
12 bottom work contacting surface
13 sub-base
14 tooling hole
15 countersunk screw holes
16 router bit
17 side edge
100 router chip guard
112 bottom work contacting surface
113 sub-base
114 tooling hole
115 countersunk screw holes
117 side edge
118 chip deflector
119 pivot pins
120 relief notch
200 router chip guard sub-base
210 router base
211 motor
212 bottom work contacting surface
213 sub-base
214 tooling hole
215 countersunk screw holes
217 side edge
218 chip deflector
219 pivot pins
220 relief notch
310 router base
312 bottom work contacting surface
313 router chip guard sub-base
314 tooling hole
315 countersunk screw holes
317 side edge
318 chip deflector
319 pivot pins
325 recessed area
326 fingertip indentation
410 router base
411 motor
412 bottom work contacting surface
413 sub-base
414 tooling hole
415 countersunk screw holes
417 side edge
418 chip deflector
427 parallel tracks
510 router base
511 motor
512 bottom work contacting surface
513 router chip guard
514 tooling hole
515 countersunk screw holes
517 side edge
518 chip deflector
519 pivot pin
610 router chip guard base
611 motor
612 bottom work contacting surface
614 tooling hole
616 router bit
617 side edge
619 pivot pins
620 relief notch

DETAILED DESCRIPTION

Referring now to Prior Art FIG. 1; Shown is a hand-held power router 8 having a motor 11 held in a router base 10. Attached to the router base 10 is a sub-base 13. The sub-base 13 has a top, a bottom work contacting surface 12 and side edge 17 around its perimeter, it also has a tooling hole 14 and countersunk screw holes 15. Extending from the motor 11 through clearance in the router base 10 and through tooling hole 14 in the sub-base 13 is a router bit 16. In further detail, still referring to prior art FIG. 1, in particular referring to the sub-base 13; sub-base 13 is flat and smooth on top and bottom. The top side is the surface which faces and contacts the router base 10 and the bottom work contacting surface 12 is the side which faces away from the router base 10. The bottom work contacting surface 12 provides a smooth, flat sliding surface for easy movement of the router 8 along a workpiece. The side edge 17 of the sub-base 13 is smooth and typically perpendicular to the top and bottom surfaces of the sub-base 13. Side edge 17 provides a guide surface which can be slid against a straight edge or template edge to allow the router 8 to follow an accurate cutting path. A tooling hole 14 is located in the sub-base 13 centered relative to the center axis of the router bit 16 providing clearance for the router bit 16. Countersunk screw holes 15 permit the sub-base 13 to be attached to the router base 10 with machine screws. The countersunk screw holes 15 allow the head of the attachment screws to be recessed below the bottom work contacting surface 12 of sub-base 13 thereby preventing marring of the work surface.

Referring now to what is currently considered a preferred embodiment of the router chip guard. The router chip guard 100 as shown in FIG. 2-5 has a sub-base 113 which has a top, a bottom work contacting surface 112, a side edge 117 and a chip deflector 118. It also has a tooling hole 114, countersunk screw holes 115 and pivot pins 119. The chip deflector 118 is hinged to the sub-base 113 within a relief notch 120 which is located at one end of the sub-base 113. The chip deflector 118 swings upon pivot pins 119.

Referring in further detail to FIG. 2-5 the router chip guard 100 has a sub-base 113 which is flat and smooth on top and bottom. The top side provides a flat surface which contacts and attaches to a router base 10 and the bottom work contacting surface 112 provides a flat and smooth non-marring slide surface which supports and steadies the tool during use. The side edge 117 of the sub-base 113 is smooth and perpendicular to the top and bottom surfaces of the sub-base 113 so as to provide a guide surface which can be slid against a straight edge or template edge to allow the router to follow an accurate cutting path. A tooling hole 114 is located within the sub-base 113 centered relative to the center axis of the router bit 116 providing sufficient clearance for different size tooling. Countersunk screw holes 115 permit the router chip guard 100 to be attached to the router base 10 with machine screws. The countersunk screw holes 115 allow the attachment screws to be recessed below the bottom work contacting surface 112 of the sub-base 113 thereby preventing marring of a workpiece. A relief notch 120 on one edge of the sub-base 113 provides clearance for the chip deflector 118 to swing upon pivot pins 119 allowing it to change from a shielding location to a non-shielding location when not useful. Pivot pins 119 pass through holes in opposite ends of side edge 117 and into aligning holes in opposite ends of the chip guard 118 providing a hinge arrangement which allows the chip deflector 118 to be manually flipped to different positions as needed. The edge of the chip deflector 118 which fits within the relief notch 120 should be radiused to allow the chip deflector 118 to swing without binding against the sub-base 113.

When the chip deflector 118 is in the non-shielding, not in use position it is generally perpendicular to the top side of sub-base 113. Further when the chip deflector 118 is in the non-shielding position no part of the chip deflector 118 protrudes beyond the bottom work contacting surface 112 of sub-base 113. As seen when comparing FIG. 3 and FIG. 4 the chip deflector 118 swings from the shielding location to the non-shielding location.

Figure 5:
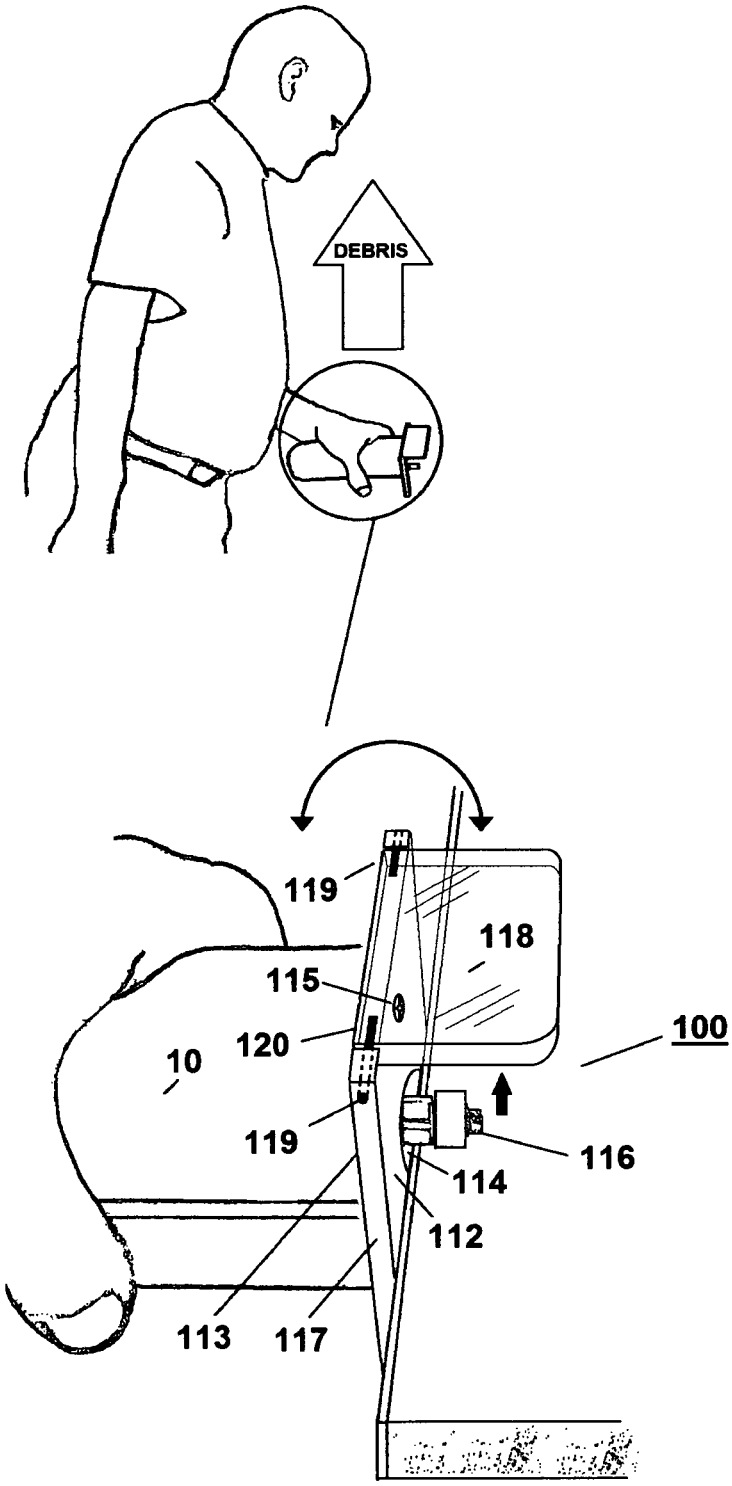
FIG. 5 is a perspective view of a partial router equipped with a router chip guard sub-base in accordance with the FIG. 2 embodiment shown held in hand with the hinged chip deflector in a shielding position, the man image shows how the router is held by the worker.

Referring now specifically to FIG. 5 which best illustrates the safety and comfort benefits of the router chip guard 100. The closeup shows a portable router being held in an operators hand gripping the router around the router base 10. Attached to the router base 10 is the sub-base 113 of router chip guard 100. The chip deflector 118 is hinged to the sub-base 113 connected by pivot pins 119, the chip deflector 118 is shown in the shielding position. As shown in the man image this particular type of routing operation requires the router be held in a horizontal position, perpendicular to the operators body and parallel to the floor. In this position the operators face is typically positioned above and over the chip deflector 118 looking down at the router bit 116 as the worker performs the trimming operation. As the router bit 116 cuts the material debris is discharged upward towards the operators face. With the chip deflector 118 in the shielding position the debris discharged hits the chip deflector 118 which substantially deflects and reduces the amount of debris that reaches the operators face. Such a routing operation is very common when for example trimming plastic laminate edges for countertops. Because countertops are typically too large to fabricate in any position other than horizontal this type of routing operation is essentially unavoidable. This example illustrates only one particular operation in which the benefits of the chip deflector 118 become clear, many others similar operations exist as well. Note that the man image is intended for illustration purposes only and is not intended to be exactly what is shown in the FIG. 5 closeup.

The construction details of the embodiment as shown in FIG. 2-5 include a router chip guard 100 having a sub-base 113 approximately 4"×4"×0.250" thick with the semi-circular side having a 2" radius. The tooling hole 114 is approximately 1.1875" in diameter and the countersunk screw holes 115 permit the use of original equipment machine screws that come with the router. The chip deflector 118 fits snugly within the relief notch 120 and is approximately 1" high and as thick as the sub-base 113. The relief notch 120 is approximately 3"×0.250" just sufficient enough in size to allow the chip deflector 118 to swing unobstructed from position to position. The long edge of the chip deflector 118 which is located within the relief notch 120 should be rounded over so that it is allowed to swing without binding against the long edge of relief notch 120. The pivot pins 119 are shown as roll pins which provide swing resistance just sufficient enough to maintain the chip deflector 118 in any given position. In the non-shielding position no part of the chip deflector 118 protrudes beyond the bottom work contacting surface 112 of the router 8, thus during non-shielded use no obstruction exists.

Still referring to FIG. 2-5 the sub-base 113 can be made of phenolic, polycarbonate or any other similar high strength, smooth non-marring material. In a preferred embodiment the chip deflector 118 should be made of transparent polycarbonate or similar high strength material which permits the operator to see the tooling and the workpiece. The tooling hole 114 can be made to accept template guides well known to the industry. The simple hinged feature of the router chip guard 100 need not be limited to the pivot pin 119 hinge arrangement disclosed herein but rather pivotal movement can be achieved by various known hinge arrangements including snap together hinge assemblies which will when required permit forcible separation of the chip deflector 118 so that it can be replaced if damaged. The size, shape, hole locations and proportions of the router chip guard embodiments can be made to fit many different router models produced by most manufacturers. It should be clearly understood that when the chip deflector is in the non-shielding location the router chip guard works just like any other basic flat original equipment router base or sub-base. It can be provided as original equipment or as an after market retrofit which can replace original equipment sub-bases which offer no similar protection from chip discharge. It should also be noted that some manufacturers for example RYOBI produce a router which has no sub-base but instead uses the bottom surface of their router base as the work contacting surface of the machine. These type bases which do not have sub-bases can also be made to incorporate the router chip guard by attaching the chip deflector to the router base in a manner similar to that discussed herein. Further still, even on routers which do have sub-bases the chip deflector may be attached to the router base itself instead of to the sub-base, thus providing additional alternate embodiments as exemplified in FIG. 8.

Figure 6:
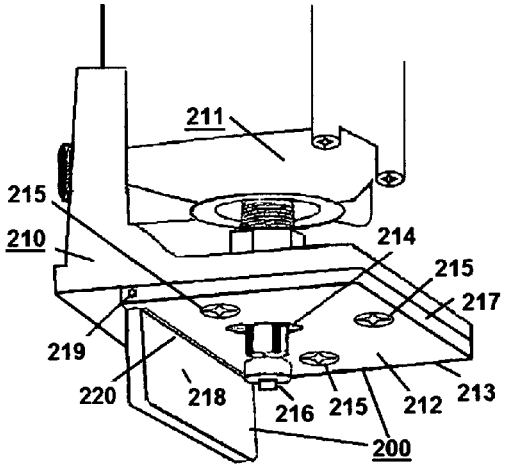
FIG. 6 is a perspective view of a partial router showing an alternate embodiment of a router chip guard sub-base shown with the hinged chip deflector in a shielding position.
Figure 7:
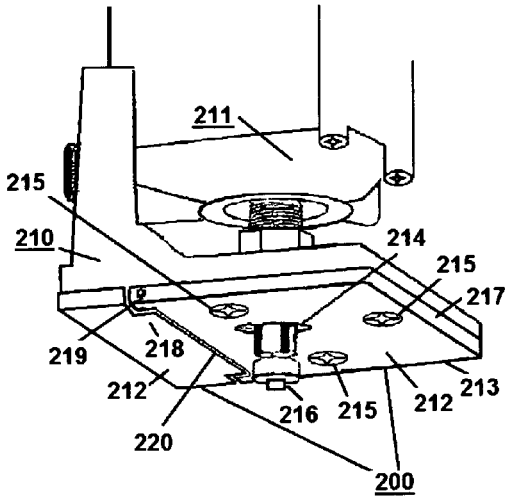
FIG. 7 is a perspective view of a partial router in accordance with the FIG. 6 embodiment shown with the hinged chip deflector in a non-shielding position.

An alternate embodiment of router chip guard 200 is shown in FIG. 6-7. In FIG. 6 the chip deflector 218 is seen in the shielding position. As shown in FIG. 7 when not in use the chip deflector 218 lies flat against the bottom of router base 210 and flush with the bottom work contacting surface 212 of sub-base 213, together they form and perform as a complete sub-base 213. In FIG. 7 the chip deflector 218 is also referenced as 212 because it performs as a bottom work contacting surface 212 when it is in the non-shielding position.

Still referring to FIG. 6-7 in greater detail the router chip guard 200 includes a sub-base 213 which is flat and smooth on top and bottom. The top side provides a flat surface which contacts and attaches to router base 210 and the bottom side provides a flat and smooth non-marring slide surface for contact with a workpiece. The side edges 217 of the sub-base 213 are smooth and perpendicular to the top and bottom surfaces of the sub-base 213 so as to provide guide surfaces which can be slid against a straight edge or template edge to allow the router to follow an accurate cutting path. A tooling hole 214 is located within the sub-base 213 centered relative to the center axis of the router bit 216 providing sufficient clearance for a router bit 216. Countersunk screw holes 215 permit the router chip guard 200 to be attached to the router base 210 with machine screws. The countersunk screw holes 215 allow the attachment screws to sit below the bottom work contacting surface 212 of the sub-base 213 thereby preventing marring of a workpiece. A relief notch 220 on one edge of the sub-base 213 provides clearance for the chip deflector 218 to swing upon pivot pins 219 allowing it to change from a shielding location to an non-shielding location as needed. Pivot pins 219 pass through holes in opposite ends of side edge 217 of the sub-base 213 and into aligning holes in opposite edges of the chip deflector 218 providing a hinge arrangement which allows the chip deflector 218 to be manually flipped to different positions as needed. The pivot pins 219 as shown are roll pins which provide swing resistance just sufficient enough to maintain the chip deflector 218 in any given position. The edge of the chip deflector 218 which fits within the relief notch 220 should be radiused to allow the chip deflector 218 to swing without binding against the sub-base 213. When desired the chip deflector 218 is repositioned approximately perpendicular to the sub-base 213 and thus into the shielding location. When not useful the chip deflector 218 is simply flipped back flat against the bottom of the router base 210 where the chip deflector 218 and the sub-base 213 form a complete basic flat sub-base 213 performing like an original equipment sub-base. With such an embodiment a manufacturer would be able to maintain the same overall dimensions as an original equipment sub-base.

Figure 8:
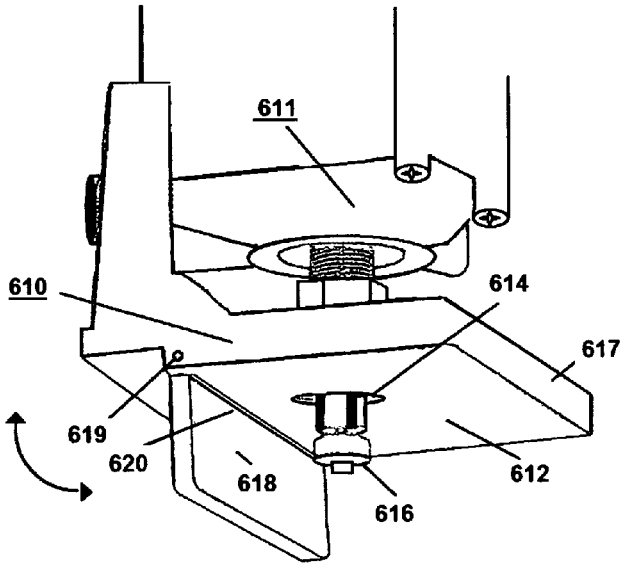
FIG. 8 is a perspective view of a partial router showing another alternate embodiment of a router chip guard router base showing a hinged chip deflector in a shielding position.

Another alternate embodiment is shown as router chip guard 610 in FIG. 8. Here router chip guard 610 has no sub-base but instead uses the bottom of the router base itself as the work contacting surface 612 of the tool. Elements including tooling hole 614, side edge 617, chip deflector 618, pivot pins 619 and relief notch 620 all perform the same as they do in the embodiments shown in FIG. 6-7 discussed above. Such an embodiment exemplifies how manufacturers who make routers that do not use a sub-base can incorporate the benefits of the present invention into their product.

Figure 9:
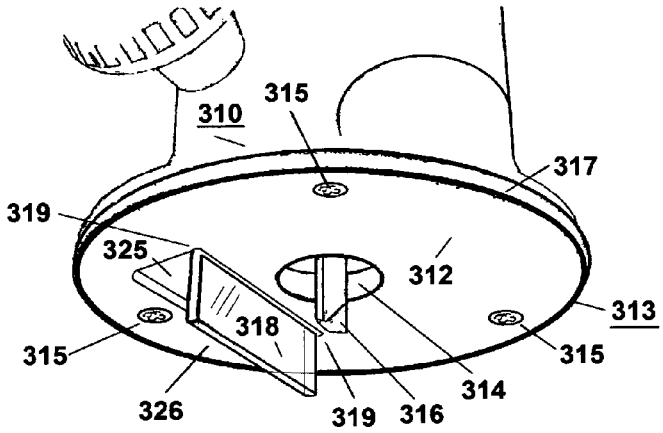
FIG. 9 is a perspective view of another alternate embodiment of a router chip guard sub-base with a hinged chip deflector in a shielding position.

Another alternate embodiment is shown in FIG. 9. Here the router chip guard sub-base 313 is attached to the router base 310 with screws located within countersunk screw holes 315. The sub-base 313 includes a tooling hole 314 and a side edge 317. In this embodiment the chip deflector 318 is hinged within a recessed area 325 located in the sub-base 313. As shown the chip deflector 318 is in the shielding position generally perpendicular to the sub-base 313 and generally parallel to the center axis of the router bit 316. During any particular router operation when the chip deflector 318 may become an obstruction it can be flipped approximately 90 degrees towards the sub-base 313 and into the recessed area 325. When housed in the recessed area 325 the chip deflector 318 lies flush with the bottom work contacting surface of sub-base 313, as such when not in use the router chip guard sub-base 313 will perform as a basic flat original equipment sub-base. When needed it is simply flipped back into the shielding location. A fingertip indentation 326 (not shown) may be formed within the work contacting surface of sub-base 313 so as to provide easy lifting of the chip deflector 318 out of the recessed area 325.

Figure 10:
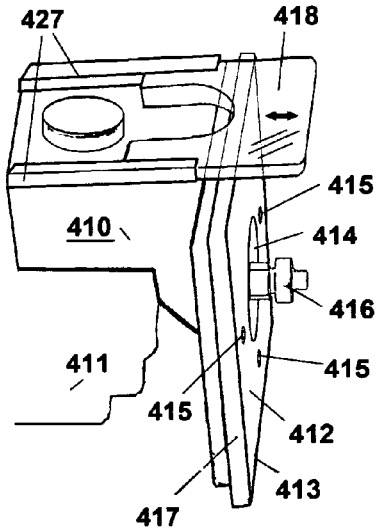
FIG. 10 is a perspective view of a partial router with yet another embodiment of a router chip guard shown with an alternate sliding chip deflector in a shielding position.
Figure 11:
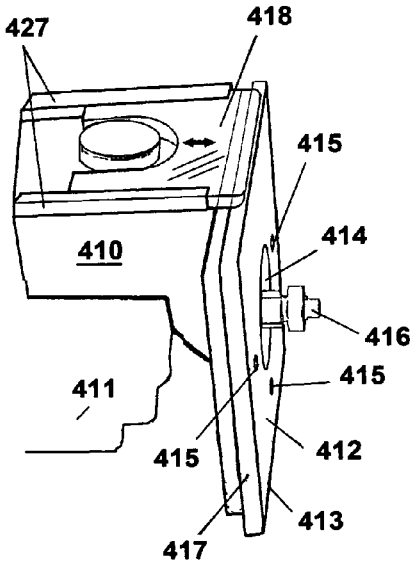
FIG. 11 is a perspective view of a partial router showing the same FIG. 10 embodiment with the alternate sliding chip deflector in a non-shielding position.

In FIG. 10-11 another alternate embodiment of the router chip guard is shown. Here the sub-base 413 is attached to the router base 410 with screws located within countersunk screw holes 415. The sub-base 413 includes a tooling hole 414 and a side edge 417. In this embodiment the chip deflector 418 is slidably mounted between parallel tracks 427. The parallel tracks 427 may be formed as an integral part of the router base 410 as shown or as an integral part of the sub-base 413 (not shown). The chip deflector 418 as shown in FIG. 10 is in the shielding location generally perpendicular to the sub-base 413 and parallel to the center axis of the router bit 416. During any particular router operation when the chip deflector 418 may become an obstruction it can be slid (as indicated by the arrow) towards the router base 410 and above the bottom work contacting surface 412 of the sub-base 413. There it is maintained in a non-shielding position as shown in FIG. 11 until needed again.

Figure 12:
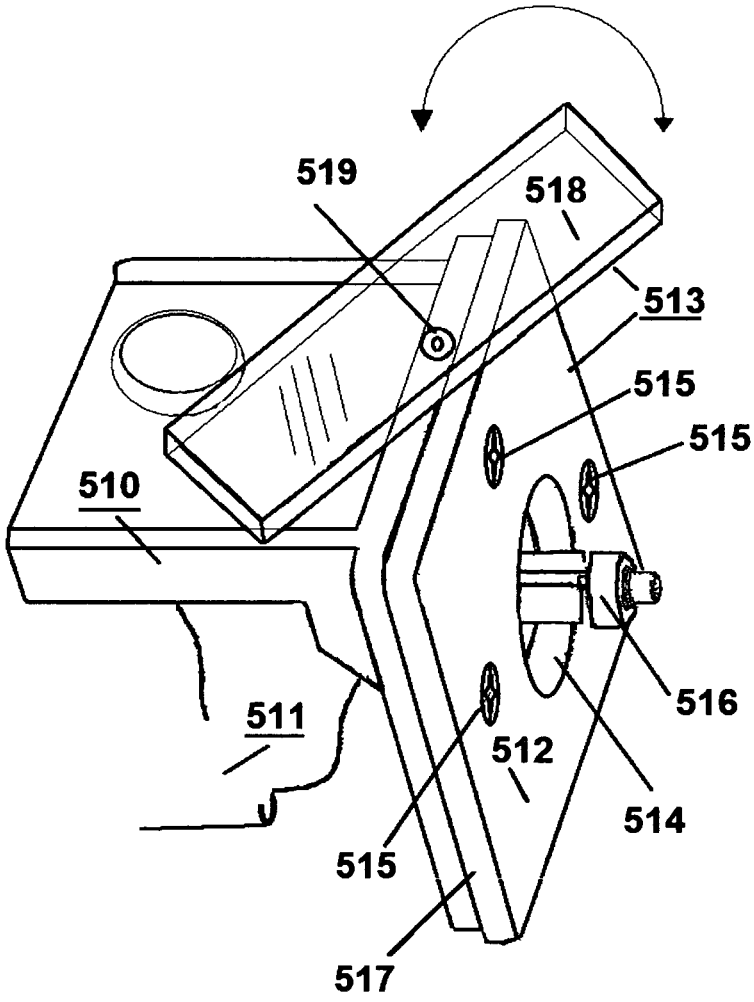
FIG. 12 is a perspective view of a partial router showing another embodiment of a router chip guard with a chip deflector which swivels upon a single pivot point.

In FIG. 12 yet another alternate router chip guard embodiment is shown. In this embodiment the chip deflector is connected to a side edge of router base 510 using a single pivot pin 519 upon which it can rotate 360 degrees or less if a stop (not shown) is desired. As such it can be be swiveled into a shielding location or into a non-shielding location as needed, it is shown in a random position for clarity. The pivot pin 519 and the chip deflector 518 may in another alternate embodiment (not shown) be connected to a side edge 517 of sub-base 513 or it may be connected to the router base 510 itself as shown.

Advantages

The router chip guard provides a lightweight, inexpensive and simple to use dual-function safety and comfort device which to date has eluded the industry. When provided on a router as an original equipment or retrofit device and used in a shielding position this guard deflects debris expelled from below the work contacting surface of the machine away from the operator. Since this is the area where all the cutting actually occurs a transparent chip deflector allows an operator to observe a cutting operation while simultaneously reducing the amount of high speed chips which reach their face and body. As with any power tool proper safety practices should always be observed including always turning off power before making any adjustments to tooling or guards and of course always wearing eye protection. Safety glasses alone cannot provide such safety and comfort. When the shielding feature is not useful a simple manual movement of the chip deflector returns it to a non-shielding out of the way position allowing the router to perform other basic router operations unobstructed. Additionally, since there is no need to remove the guard between different operations there is no downtime and no need for tools. The chip deflector is always on board therefore it can't get lost. The present invention provides a simple, useful and cost-effective safety and comfort benefit beyond that provided by any other router guard. The router chip guard performs as a safety device and/or as a basic flat bottom work contacting surface just like an original equipment base or sub-base.

Although the description above contains many specificities, those should not be construed as limiting the scope of the embodiments but as merely providing illustrations of some of the presently preferred embodiments.

I claim:

1. A chip guard for a hand held power router comprising:

a. a chip deflector slidably re-positionable relative to a bottom work contacting surface of a router b. said chip deflector slidable substantially perpendicular relative to said bottom work contacting surface of said router c. said chip deflector slidably positionable to a shielding location below said bottom work contacting surface of said router thereby enabling said chip deflector to deflect cutting debris away from an operator d. said chip deflector slidably positionable to a non-shielding location at least flush with said bottom work contacting surface of said router so that no portion of said chip deflector protrudes beyond said bottom work contacting surface of said router,
and e. means for slidably mounting said chip deflector to said router, whereby enabling repositioning of said chip deflector to and from said shielding location and said non-shielding location.

2. The chip guard of claim 1 wherein said means for mounting said chip deflector to said router includes slidably mounting said chip deflector between parallel tracks disposed perpendicular above said bottom work contacting surface of said router.

3. A chip guard for a hand held power router comprising:

a. a router base having a bottom work contacting surface b. a chip deflector re-positionable via a fixed pivot point relative to said bottom work contacting surface of said router base c. said chip deflector movably positionable via said fixed pivot point to a shielding location below said bottom work contacting surface of said router base thereby enabling said chip deflector to deflect cutting debris away from an operator d. said chip deflector movably positionable via said fixed pivot point to a non-shielding location at least flush with said bottom work contacting surface of said router base so that no portion of said chip deflector protrudes beyond said bottom work contacting surface of said router base,
and e. means for pivotally connecting said chip deflector to a side of said router base, whereby enabling repositioning of said chip deflector to and from said shielding location and said non-shielding location.

4. A chip guard for a hand held power router comprising:

a. a router sub-base having a bottom work contacting surface b. a chip deflector re-positionable via a fixed pivot point relative to said bottom work contacting surface of said router sub-base c. said chip deflector movably positionable via said fixed pivot point to a shielding location below said bottom work contacting surface of said router sub-base thereby enabling said chip deflector to deflect cutting debris away from an operator d. said chip deflector movably positionable via said fixed pivot point to a non-shielding location at least flush with said bottom work contacting surface of said router sub-base so that no portion of said chip deflector protrudes beyond said bottom work contacting surface of said router sub-base,
and e. means for pivotally connecting said chip deflector to a side of said router sub-base, whereby enabling repositioning of said chip deflector to and from said shielding location and said non-shielding location.

5. A chip guard for a hand held power router comprising:

a. a router base b. said router base having a sub-base c. said sub-base having a bottom work contacting surface d. a chip deflector re-positionable via a fixed pivot point relative to said bottom work contacting surface of said router sub-base e. said chip deflector movably positionable via said fixed pivot point to a shielding location below said bottom work contacting surface of said router sub-base thereby enabling said chip deflector to deflect cutting debris away from an operator f. said chip deflector movably positionable via said fixed pivot point to a non-shielding location at least flush with said bottom work contacting surface of said router sub-base so that no portion of said chip deflector protrudes beyond said bottom work contacting surface of said router sub-base,
and g. means for pivotally connecting said chip deflector to a side of said router base, whereby enabling repositioning of said chip deflector to and from said shielding location and said non-shielding location.

* * * * *